US010465343B2

(12) United States Patent
Cheng et al.

(10) Patent No.: US 10,465,343 B2
(45) Date of Patent: Nov. 5, 2019

(54) OVERPASS STRUCTURE WITH VERTICAL INTERCHANGE ARRANGEMENT FOR CROSSROADS

(71) Applicants: Dawei Cheng, Shenzhen (CN); Haitang Cheng, Shenzhen (CN)

(72) Inventors: Dawei Cheng, Shenzhen (CN); Haitang Cheng, Shenzhen (CN)

( * ) Notice: Subject to any disclaimer, the term of this patent is extended or adjusted under 35 U.S.C. 154(b) by 85 days.

(21) Appl. No.: 15/841,277

(22) Filed: Dec. 13, 2017

(65) Prior Publication Data

US 2019/0177921 A1 Jun. 13, 2019

(51) Int. Cl.

| | |
|---|---|
| ***E01C 1/04*** | (2006.01) |
| ***B61B 1/00*** | (2006.01) |
| ***E01C 15/00*** | (2006.01) |
| ***E01C 9/00*** | (2006.01) |
| ***B61B 13/10*** | (2006.01) |

(52) U.S. Cl.

CPC ..... *E01C 1/04* (2013.01); *B61B 1/00* (2013.01); *E01C 9/008* (2013.01); *E01C 15/00* (2013.01); *B61B 13/10* (2013.01)

(58) Field of Classification Search

CPC ... E01C 1/04; E01C 1/002; E01C 1/02; E01C 9/00; E01C 9/008; E01C 15/00; E01D 1/00; B61B 13/10; B61B 1/00

See application file for complete search history.

(56) References Cited

U.S. PATENT DOCUMENTS

| | | | | |
|---|---|---|---|---|
| 3,847,496 | A * | 11/1974 | Stankiewicz | E01C 1/002 404/1 |
| 4,272,210 | A * | 6/1981 | Shoji | E01C 1/04 404/1 |
| 5,049,000 | A * | 9/1991 | Mier | E01C 1/04 14/78 |
| 5,807,020 | A * | 9/1998 | Chen | E01C 1/04 404/1 |
| 7,491,009 | B1 * | 2/2009 | Remy | E01C 1/04 404/1 |
| 2007/0086855 | A1 * | 4/2007 | Niiya | E01C 1/04 404/1 |
| 2007/0237576 | A1 * | 10/2007 | Peng | E01C 1/04 404/1 |

(Continued)

*Primary Examiner* — Abigail A Risic

(74) *Attorney, Agent, or Firm* — Novoclaims Patent Services LLC; Mei Lin Wong

(57) ABSTRACT

An overpass structure with vertical interchange arrangement for crossroads includes a transverse roadway at a bottom level, a pedestrian walkway in the middle level and a longitudinal road bridge at an upper level. The vehicle roadways on and under the bridge are connected by two ramp units. The pedestrian walkway is a pedestrian platform with an interchange platform provided on top. The interchange platform is located between and connected to two roadways of opposite directions on the longitudinal road bridge in the upper level. The leftmost lane along a forward moving direction of vehicle on the bridge in the longitudinal road bridge is defined as a universal lane of the longitudinal road bridge. The rightmost lane along a forward moving direction of vehicle under the bridge in the transverse roadway is defined as a universal lane of the transverse roadway. The interchange platform is connected to four universal lanes.

8 Claims, 7 Drawing Sheets

(56) References Cited

U.S. PATENT DOCUMENTS

| | | | | |
|---|---|---|---|---|
| 2008/0152426 | A1* | 6/2008 | Liu | E01C 1/04 404/1 |
| 2009/0052983 | A1* | 2/2009 | Goj | E01C 1/04 404/1 |
| 2010/0111601 | A1* | 5/2010 | Sutchiewcharn | E01C 1/04 404/1 |
| 2014/0205376 | A1* | 7/2014 | Derenoncourt | E01C 1/04 404/1 |

* cited by examiner

OVERPASS STRUCTURE WITH VERTICAL INTERCHANGE ARRANGEMENT FOR CROSSROADS

BACKGROUND OF THE PRESENT INVENTION

Field of Invention

The present invention relates to road and bridge facilities and, more particularly to a vertical transfer overpass for crossroads.

Description of Related Arts

In city roads, the traffic light at the crossroads can command the safe and orderly passage of pedestrians and vehicles. However, pedestrians and vehicles need to wait for the green light patiently, which results in a waste of time. If the four-way intersection (crossroad) employs appropriate interchange vertical overpass, the travel time for vehicles will be shortened dramatically.

At present, there are many different types of interchange vertical overpass designs. Some structures are complex and cover a large area, which are not suitable for crossroads in urban areas. There are also interchange vertical overpass designed for crossroads. However, the ramps interconnecting the bridge and under the bridge often occupy the auxiliary lanes under the bridge. As a result, the number of auxiliary lanes is reduced and the land is wasted. Also, it is likely to cause the traffic bottlenecks easily. Some overpasses do not allow road sharing for both people and vehicles. Some overpasses allow road sharing for both people and vehicles but pedestrians need to go up, down, bypass or be mixed with vehicles. In addition, under the influence of continuous rainstorms, the phenomenon of waterlogging in cities is commonly occurred. At this point, water accumulation under the bridge at the crossroads of interchange overpasses may easily be caused. If the drainage of water is not timely, the passage under the bridge is not possible.

Chinese inventive patent application number CN 20131075076.3 provides a vertical overpass for crossroads, which includes a horizontal road bridge and a vertical road bridge, characterized in that: a U-turn bridge for motor vehicle, which are arranged for left turn and U-turn of motor vehicle, is provided at the horizontal road at two ends of the horizontal road bridge, wherein the U-turn bridge for motor vehicle includes an uphill curve bridge or a flat curve bridge; a U-turn road for motor vehicle, which is arranged for U-turn of motor vehicle, is provided at the vertical road at two ends of the vertical road bridge, wherein the U-turn road includes a downhill ground U-turn road. When the overpass for crossroads of the above invention is used, without the use of traffic lights, motor vehicles, bicycles, pedestrians at all directions can have passage without crossing and therefore traffic jams can be reduced. The overpass of this Chinese inventive patent application provides a U-turn bridge for motor vehicle for left turn and U-turn of motor vehicle at the horizontal road at two ends of the horizontal road bridge, wherein the U-turn bridge for motor vehicle includes an uphill curve bridge or a flat curve bridge; and a U-turn road for motor vehicle provided at the vertical road at two ends of the vertical road bridge for U-turn of motor vehicle, wherein the U-turn road includes a downhill U-turn road on the ground. The U-turn of vehicles at both vertical and horizontal road need to adopt a three-dimensional cross-form, which has a complex structure and imposes a great difficulty in construction.

SUMMARY OF THE PRESENT INVENTION

An object of the present invention is to provide an overpass with vertical interchange arrangement for crossroads which is simple in structure and easy for construction, while facilitating motor vehicles to change direction, passenger interchange and passage of people and vehicles.

Additional advantages and features of the invention will become apparent from the description which follows, and may be realized by means of the instrumentalities and combinations particular point out in the appended claims.

According to the present invention, the foregoing and other objects and advantages are attained by an overpass structure with vertical interchange arrangement for crossroads, which comprises a transverse roadway at a bottom level and a longitudinal road bridge at an upper level, wherein each of the transverse roadway and the longitudinal road bridge comprises two vehicle roadways of opposite driving directions respectively, wherein each of the vehicle roadways comprises a plurality of road lanes in the same driving direction, wherein the transverse roadway at the bottom level and the longitudinal road bridge at the upper level are connected through by two reversing ramp units, wherein the two reversing ramp units are symmetrically arranged on two sides of the transverse roadway, each of the reversing ramp units is arranged between two longitudinal vehicle roadways of opposite directions in the longitudinal road bridge; each of the reversing ramp units comprises one annular ramp and two auxiliary lanes; wherein the annular ramp is arranged between the two auxiliary lanes and is connected to the two auxiliary lanes; wherein the auxiliary lane which is adjacent to an uphill roadway of the longitudinal road bridge is defined as a first auxiliary lane, wherein the auxiliary lane which is adjacent to a downhill roadway of the longitudinal road bridge is defined as a second auxiliary lane; wherein a starting point of the first auxiliary lane is connected to a starting point of the uphill roadway of the longitudinal road bridge, extends forwardly, tangential to the annular ramp, then extends downward to the bottom of the bridge and then turns right to connect with the transverse roadway; the starting point of the second auxiliary lane is connected with the transverse roadway at the bottom of the bridge, turns to the right and then extends upwards, tangential to the annular ramp, and then extends horizontally forward, then an end point is connected to an end point of the downhill roadway of the longitudinal road bridge.

Preferably, according to the above overpass structure with vertical interchange arrangement for crossroads, each of the reversing ramp units comprises two short ramps, which are an uphill road defining a first short ramp and a downhill road defining a second short ramp, having one end connected to the annular ramp and another end connecting to the two vehicle roadways of opposite driving directions of the longitudinal road bridge respectively so that the two separated vehicle roadways of opposite driving directions are connected together.

Preferably, according to the above overpass structure with vertical interchange arrangement for crossroads, the overpass structure further includes a pedestrian walkway and the pedestrian walkway comprises a pedestrian platform. The pedestrian walkway has a crisscross shape formed by two pairs of parallel lines that intersect perpendicularly to each other to form a quadrilateral in the middle. The pedestrian walkway comprises two longitudinal walkways and two transverse walkways. The longitudinal walkway is located at an outer side of the vehicle roadways of the longitudinal road bridge and the transverse walkway is located at an outer side of the vehicle roadways of the transverse roadway. The transverse roadway penetrates through under the middle of the pedestrian walkway. The interchange platform is on top of the pedestrian platform.

Preferably, according to the above overpass structure with vertical interchange arrangement for crossroads, the pedestrian walkway comprises a pedestrian platform located in the quadrilateral in the middle of the crisscross shape. The pedestrian walkway, including the pedestrian platform, the end of the longitudinal road bridge, the end of the transverse roadway, and the two annular ramps are located at the same level. Therefore the pedestrians walking in the pedestrian walkway do not need to go up and down or bypass.

Preferably, according to the above overpass structure with vertical interchange arrangement for crossroads, the longitudinal road bridge comprises an interchange platform located at the top end of the longitudinal road bridge, and is between two vehicle road lanes of opposite directions in the longitudinal road bridge, while connecting to two vehicle road lanes of the longitudinal road bridge, wherein the interchange platform comprises a bus station and an apron.

Preferably, according to the above overpass structure with vertical interchange arrangement for crossroads, the overpass structure further comprises a subway station located right below the crossroads junction under the ground; wherein the subway station is connected to the pedestrian platform and the interchange platform through an elevator and a pedestrian stairway.

Preferably, according to the above overpass structure with vertical interchange arrangement for crossroads, a universal lane is provided on the bridge and under the bridge and are connected by the reversing ramp unit, wherein the universal lane on the bridge in the longitudinal road bridge is the leftmost lane with respect to a forward moving direction of vehicle, wherein the universal lane under the bridge in the transverse roadway is the rightmost lane with respect to a forward moving direction of vehicle.

Preferably, according to the above overpass structure with vertical interchange arrangement for crossroads, the interchange platform is connecting the two universal lanes of the longitudinal road bridge, the universal lanes of the longitudinal road bridge and the transverse roadway are connected through the reversing ramp unit, the interchange platform is connected to the pedestrian platform and the subway station below through an elevator or a pedestrian stairway.

Preferably, the interchange platform is a universal area arranged for anyone who reaches the universal area to go to any places by means of transportation or walking, and for any vehicle that reaches the universal area to go to any lanes in any direction. The crossroads are the intersection of four junctions between two roadways. The interchange platform of the present invention is connected to the four junctions of the crossroads and is capable of connecting to two additional junctions of which a corresponding walkway and roadway of the two additional junctions are connected to the universal area. Alternately, the corresponding walkway and roadway of the two additional junctions are connected to the original four junctions through the universal area, the universal lane and the reversing ramp unit. The universal area is capable of development to provide other functions based on an actual need requirement by addition or modification and the interchange function is only one of the different functions of the universal area.

Preferably, according to the above overpass structure with vertical interchange arrangement for crossroads, the application of the overpass structure is not limited to crossroads and the overpass structure can be applied to other geographical locations. The overpass structure can be used in intersection of two roadways with four junctions, or can be used in intersection with five or six junctions. The structural elements can be added or modified based on the need.

The advantageous effect of the present invention is that the overpass with vertical interchange arrangement for crossroads has a simple structure which facilitates easy construction. Also, facilities are provided to facilitate motor vehicles to change direction, passenger interchange and passage of people and vehicles.

Still further objects and advantages will become apparent from a consideration of the ensuing description and drawings. These and other objectives, features, and advantages of the present invention will become apparent from the following detailed description, the accompanying drawings, and the appended claims.

BRIEF DESCRIPTION OF THE DRAWINGS

The present invention is further described with the accompany drawings and preferred embodiment.

DETAILED DESCRIPTION OF THE PREFERRED EMBODIMENT

Figure 1:
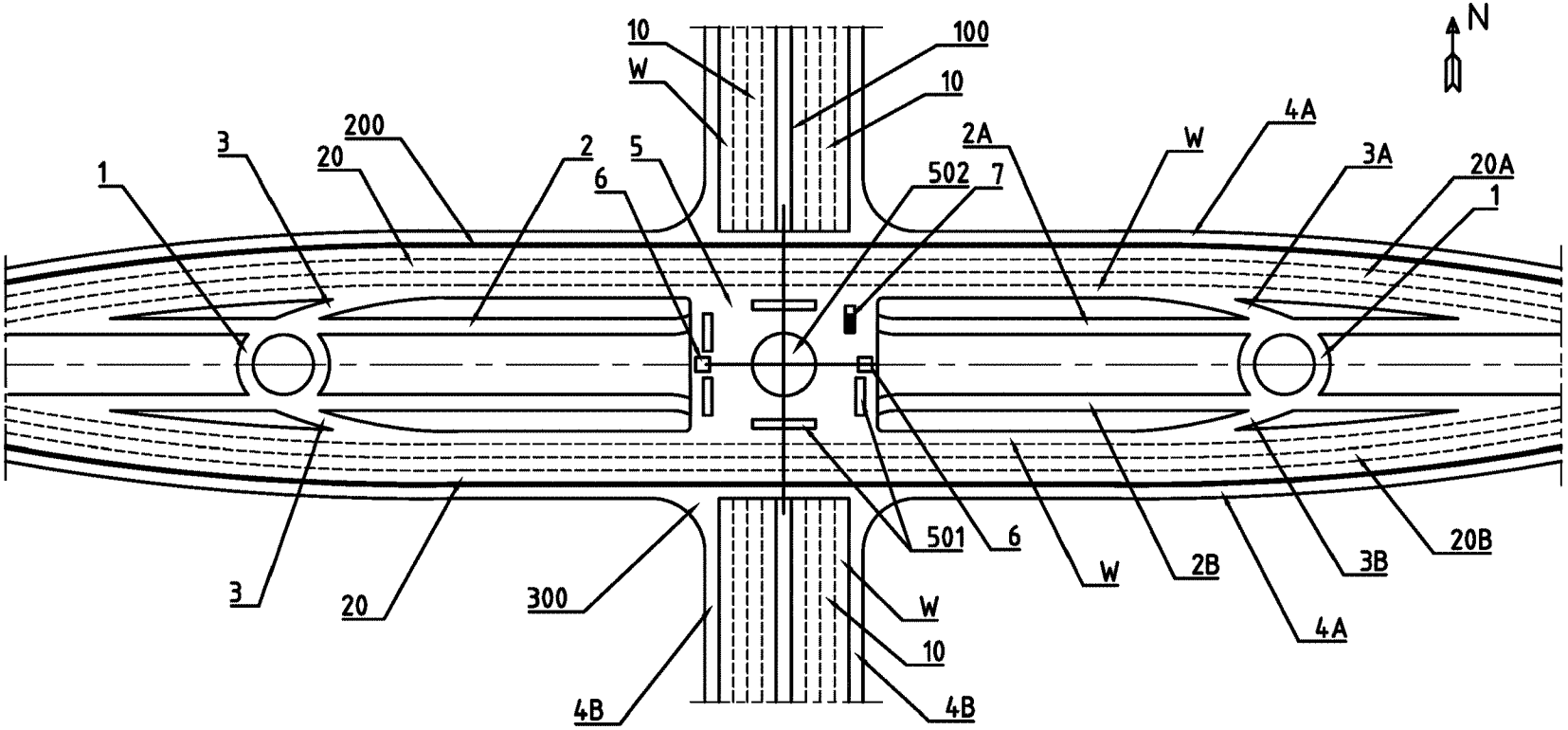
FIG. 1 is a schematic top view of an overpass with vertical interchange arrangement for crossroads according to a first preferred embodiment of the present invention.
Figure 2:
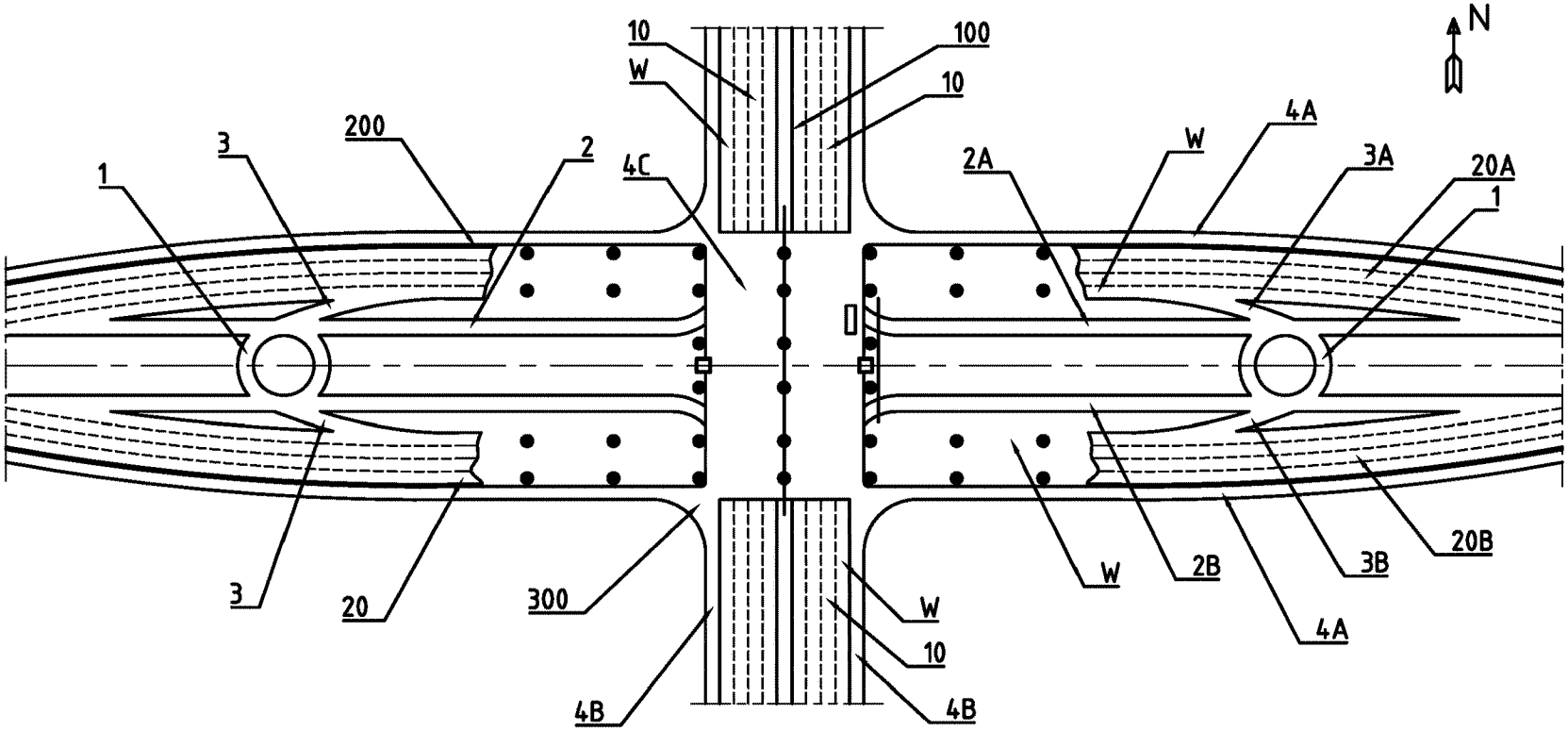
FIG. 2 is a first partial sectional view of the schematic top view of an overpass with vertical interchange arrangement for crossroads according to the above first preferred embodiment of the present invention.
Figure 3:
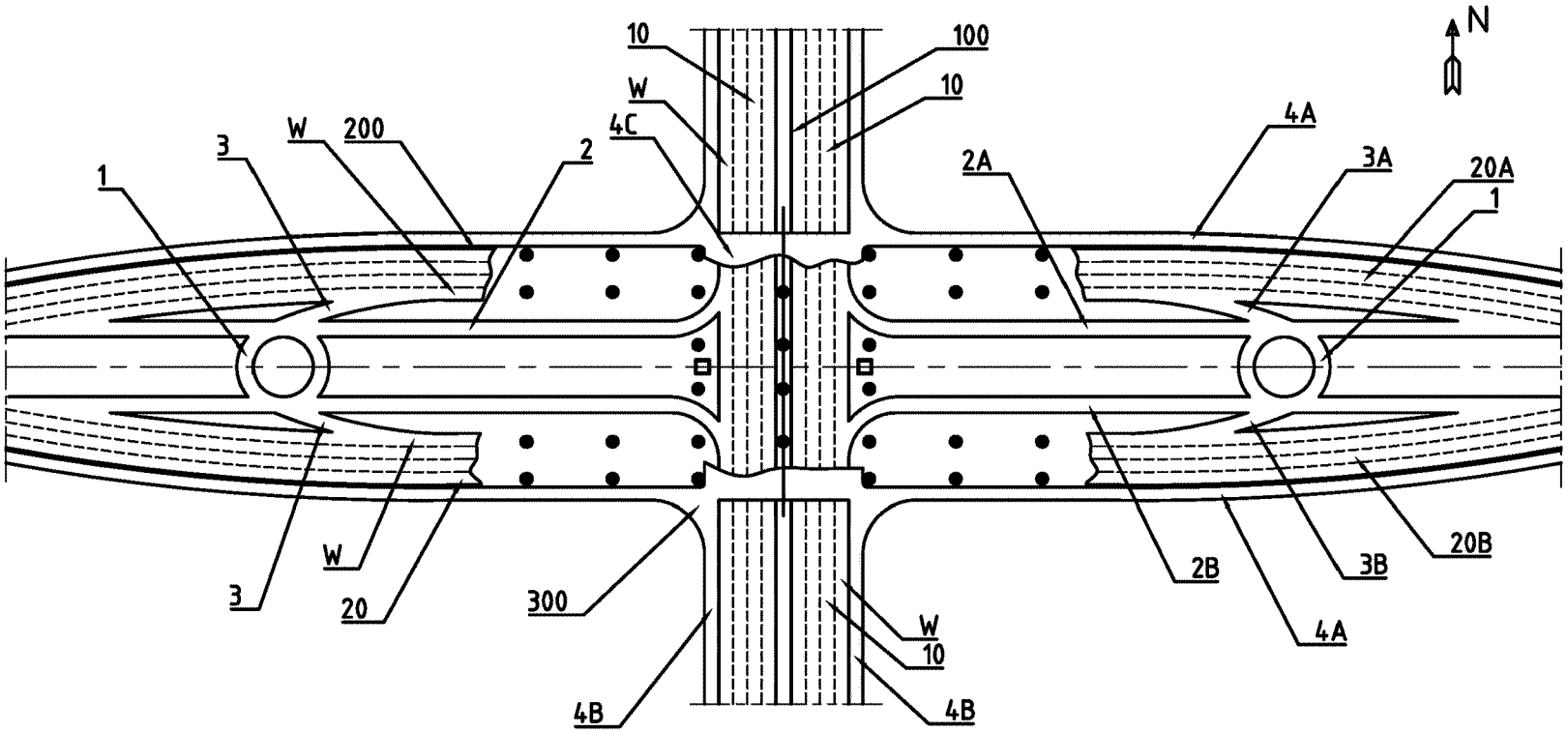
FIG. 3 is a second partial sectional view of the schematic top view of an overpass with vertical interchange arrangement for crossroads according to the above first preferred embodiment of the present invention.
Figure 4:
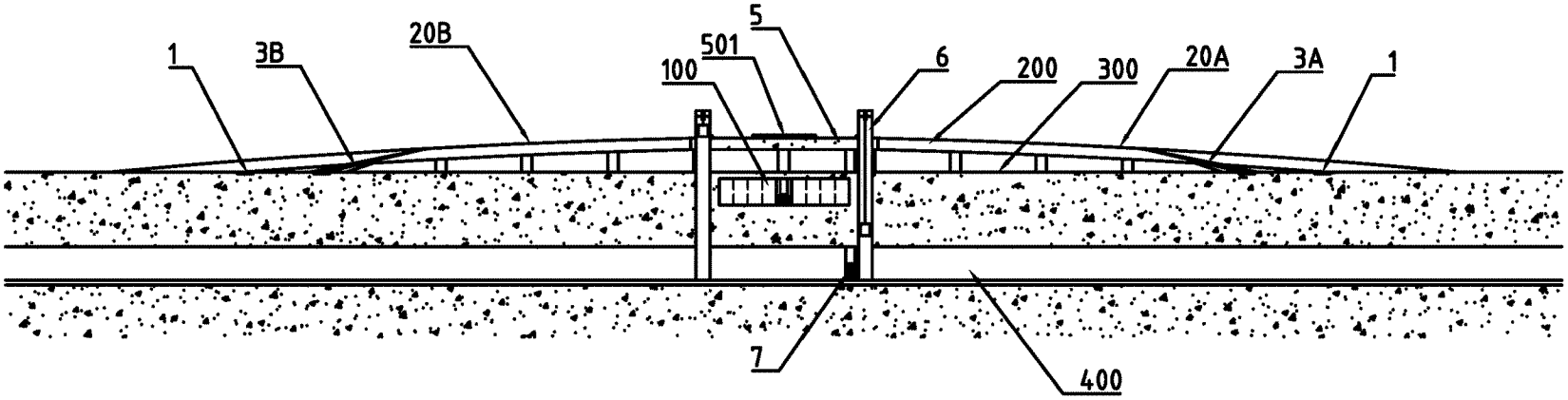
FIG. 4 is a first partial sectional view of the schematic side view of an overpass with vertical interchange arrangement for crossroads according to the above first preferred embodiment of the present invention.
Figure 5:
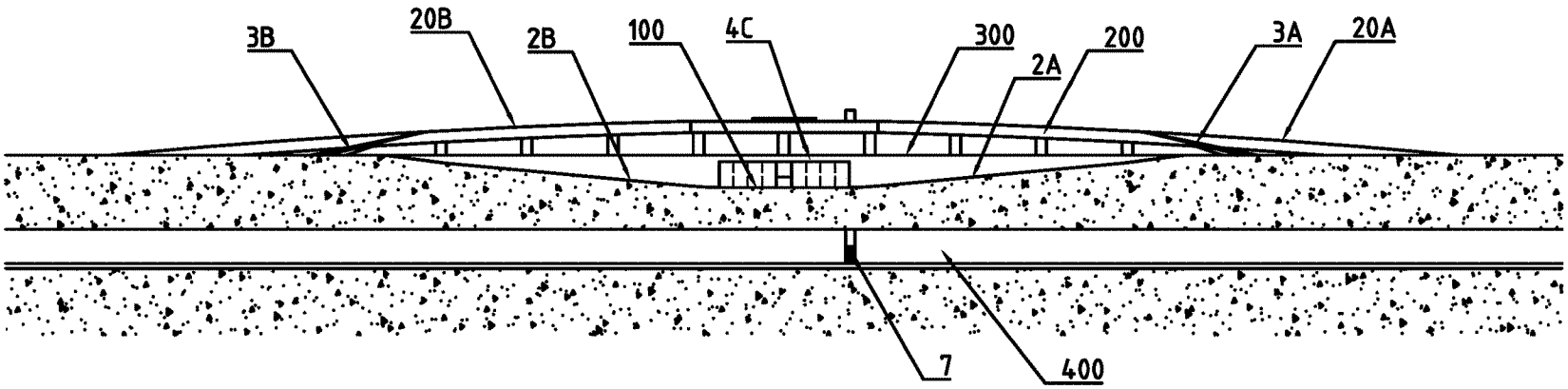
FIG. 5 is a second partial sectional view of the schematic side view of an overpass with vertical interchange arrangement for crossroads according to the above first preferred embodiment of the present invention.

The preferred embodiment of the present invention is further described with the accompanying drawings as follows and is not intended to be limiting.

Referring to FIG. 1 to FIG. 5 of the drawings, an overpass with vertical interchange arrangement for crossroads according to a first preferred embodiment of the present invention comprises a transverse roadway 100, a longitudinal road bridge 200, a pedestrian walkway 300 and a subway station 400.

The transverse roadway 100 passes under a pedestrian platform 4C of the pedestrian walkway 300. An interchange platform 5 and the longitudinal road bridge 200 are above the pedestrian platform 4C.

The transverse roadway 100 comprises two transverse vehicle roadways 10 of opposite driving directions. Each of the transverse vehicle roadways 10 comprises a plurality of transverse vehicle road lanes in the same driving direction. The longitudinal road bridge 200 comprises two longitudinal vehicle roadways 20 of opposite driving directions. Each of the longitudinal vehicle roadways 20 comprises a plurality of longitudinal vehicle road lanes in the same driving direction.

In the vehicle roadways of the longitudinal road bridge 200 and the transverse roadway 100, two vehicle road lanes W are defined in each of the longitudinal road bridge 200 and the transverse roadway 100 respectively. The vehicle road lane W is a universal lane. The universal lane W of the longitudinal road bridge 200 refers to the leftmost lane with respect to a forward moving direction of vehicle. The universal lane W of the transverse roadway 100 refers to the rightmost lane with respect to a forward moving direction of vehicle.

A pair of reversing ramps is symmetrically arranged on both sides of the transverse roadway 100, and each reversing ramp comprises one annular ramp, two short ramps and two auxiliary lanes. The reversing ramp is arranged between two longitudinal vehicle roadways 20 of opposite directions of the longitudinal road bridge 200. The annular ramp 1 is arranged between the two auxiliary lanes 2, tangent to the middle of the two auxiliary lanes 2.

Take the side where the longitudinal road bridges 2A and 2B are located as an example. The first auxiliary lane 2A is adjacent to the bridge entrance section of a universal lane W in the longitudinal road bridge 200. The starting point of the auxiliary lane 2A is the same as the starting point of the universal lane W entering into the overpass. Starting from the starting point, W extends upward to the top of the bridge while the auxiliary lane 2A extends horizontally forward first to reach the annular ramp 1 and then extends downwards and to the right of the bridge to reach the bottom of the bridge and to connect with a universal lane W of the transverse roadway 100. The second auxiliary lane 2B is adjacent to the bridge exit section of another universal lane W in the longitudinal road bridge 200 and the ends of the two are connected. The starting point of 2B is connected with the universal lane W of the transverse roadway 100, then extends to the right and extends upwards to reach the annular ramp 1, then continues to extend forward in the horizontal direction until it intersects the universal lane W that extends downward from the top of the bridge.

The first short ramp 3A is an uphill ramp. The starting point of the uphill ramp 3A is connected to the annular ramp 1, and the end point is connected to the bridge entrance section of the universal lane W of the longitudinal road bridge 200; the second ramp 3B is a downhill ramp, the starting point of the downhill ramp 3B is connected to the bridge exit section of another universal lane W of the longitudinal road bridge 200.

The pedestrian walkway 300 has a crisscross shape formed by two pairs of parallel lines that intersect perpendicularly to each other to form a quadrilateral in the middle. The pedestrian walkway 300 comprises two longitudinal walkways 4A, two transverse walkways 4B and a pedestrian platform 4C. The longitudinal walkway 4A is located at an outer side of the longitudinal road bridge 200 and the transverse walkway 4B is located at an outer side of the transverse vehicle roadways 10 of the transverse roadway 100.

The longitudinal walkways 4A, the transverse walkways 4B, the pedestrian platform 4C, the end of the transverse roadway 100 and the longitudinal road bridge 200, and the annular ramp are located at the same ground plane. (at the same level under ideal condition)

The pedestrian platform 4C is located in the middle of the pedestrian walkway 300 and communicates with the two longitudinal walkways 4A and the two transverse walkways 4B. The pedestrian walkway 300 is located in the normal ground level. The pedestrians walking in the pedestrian walkway 300 basically do not need to go up and down or bypass.

The pedestrian platform 4C is a solid plate, which is an equivalent of an overhead floor. Appropriate widening of the widths of the pedestrian walkways 4A and 4B (which includes non-motorized vehicle lanes) may be used as emergency lanes in exceptional circumstances such as waterlogging at the bridge bottom in the event of a waterlogging.

The longitudinal road bridge 200 has an interchange platform 5 which is located at the top of the middle of the longitudinal road bridge 200 and is located between two longitudinal vehicle roadways 20 of opposite directions of the longitudinal road bridge 200, which is arranged for connecting the two longitudinal vehicle roadways 20 of the longitudinal road bridge 200. The interchange platform 5 has a plurality of bus stations 501 and a helicopter apron 502 at the center of the interchange platform 5.

The subway station 400 is located deep underground right below the pedestrian platform 4C. The subway station 400 is connected with the pedestrian platform 4C and the interchange platform 5 through an elevator 6 and a pedestrian stairway 7.

Figure 6:
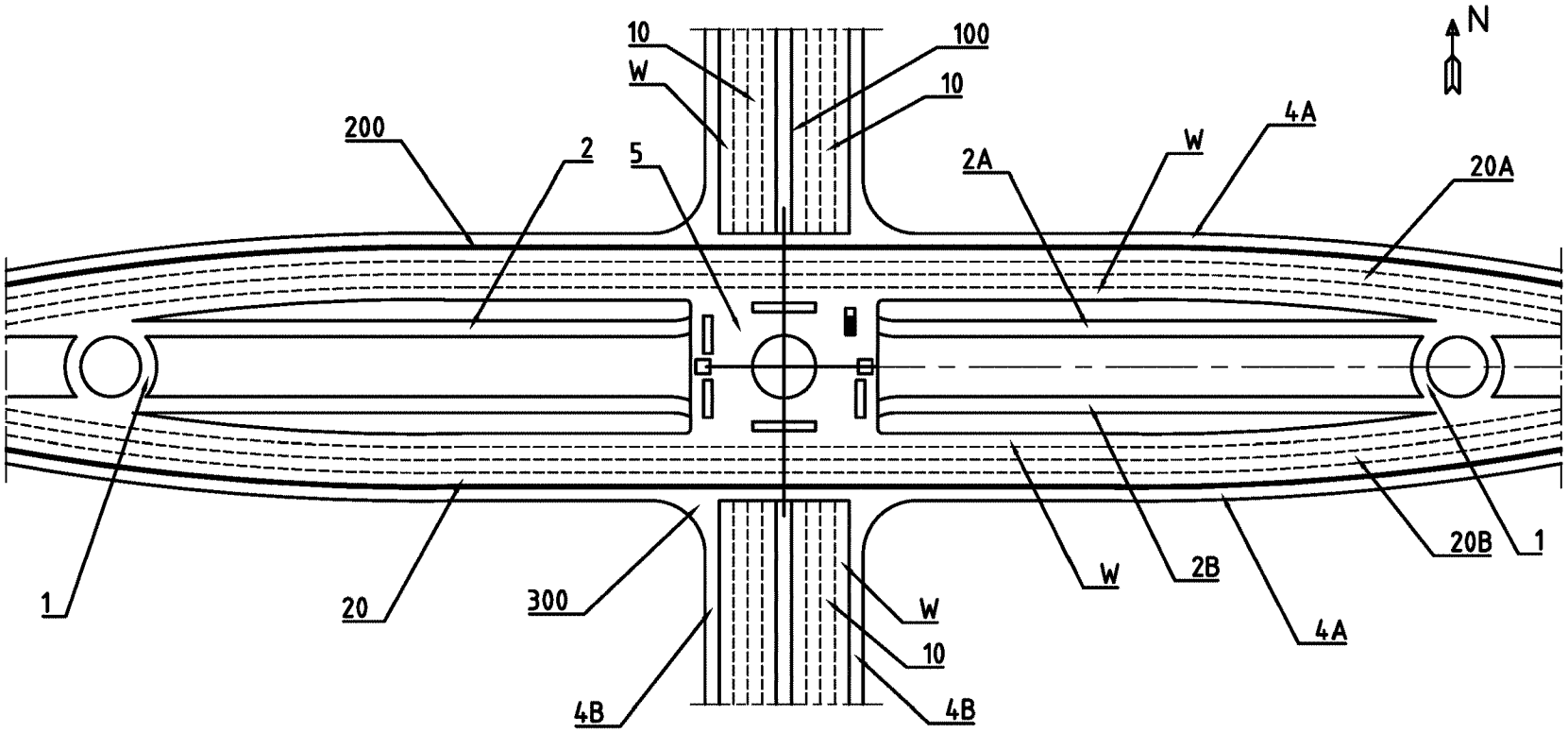
FIG. 6 is a schematic top view of an overpass with vertical interchange arrangement for crossroads according to a second preferred embodiment of the present invention.

Referring to FIG. 6 of the drawings, an overpass with vertical interchange arrangement for crossroads according to a second preferred embodiment of the present invention is illustrated. Compared to the first preferred embodiment of the present invention, the differences of the second embodiment is that the annular ramp 1 is not located in the middle of the two auxiliary lanes 2 but at the ends of the two auxiliary lanes 2. The annular ramp 1 is connected to the two auxiliary lanes 2 respectively and is at the same time connected to the end of the two universal lanes W with opposite directions in the longitudinal road bridge 200, so the ramp 3A and the ramp 3B in the Embodiment 1 are not required, and the structure is even simpler.

According to the overpass with vertical interchange arrangement for crossroads of the present invention, the overpass with vertical interchange arrangement for crossroads has a main body which comprises three levels. The upper level is the vehicle roadway on the bridge, the bottom level is the vehicle roadway under the bridge, and the middle level is a plane for passage of pedestrian and non-motorized vehicles.

According to the overpass with vertical interchange arrangement for crossroads of the present invention, the middle level is a plane for passage of pedestrian and non-motorized vehicles which is formed along the cross streets to the shape of two pair of parallel lines that intersect perpendicularly to form a quadrilateral in the middle. The middle is solid in structure and is overhead at the middle portion of the overpass, just like a whole floor. The middle level is completely separated from the motor vehicle roadways. The pedestrian can move freely in the solid structure at any direction without moving up and down or bypass.

According to the overpass with vertical interchange arrangement for crossroads of the present invention, the universal lane W is provided. Now it is assumed that the roadway under the bridge is north-south direction and the roadway on the bridge is east-west direction. Then, in the roadway to the south or north under the bridge, when a vehicle moves forward, the lane on the rightmost location is the universal lane W. In the roadway to the east or west on the bridge, when a vehicle moves forward, the lane on the leftmost location is the universal lane W. The roadways on the bridge and under the bridge are interconnected through the reversing ramp. In fact, the rightmost lane under the bridge is connected with the leftmost lane on the bridge through the reversing ramp. That is to say, the universal lanes W under the bridge and on the bridge are connected with each other through the reversing ramp. After a vehicle located at any one of the universal lanes W under the bridge or on the bridge enters the overpass structure, it can go straight, or it can make a left turn, a right turn or a U-turn through the reversing ramp and the corresponding universal lane W. All these can be completed in the universal lane W and the reversing ramp and do not affect the other straight lane on the roadway.

The vehicle on the universal lane W in the south direction is used as an example for a vehicle on the universal lane W under the bridge. After the vehicle enters under the bridge, the vehicle can go straight; if a right turn is needed, the vehicle can go to the right to go upward through the auxiliary lane 2, and then passing through the annular ramp and go forward to enter the universal lane W in the west direction to complete the right turn; if a left turn is needed, the vehicle can go to the right to go upward through the auxiliary lane 2, and when the annular ramp 1 is reached, make a left turn along the annular ramp, and go forward to enter the universal lane W in the east direction along the upward ramp to complete the right turn; if a U-turn is needed, the vehicle can enter into the universal lane W in the east direction from the same steps illustrated above, then after passing the bridge top, from the downward ramp 3B to enter into the annular ramp 1, make a left turn to enter the auxiliary lane 2A, going down along 2A and right turn to the bridge bottom, enter the universal lane W in the north direction and the U-turn is completed.

The vehicle on the universal lane W in the east direction is used as an example for a vehicle on the universal lane W on the bridge. The vehicles are moving from west to east direction. When the vehicles enter into the overpass structure, the vehicles start to divert. The vehicles needed to go straight in the east direction drive along the original lane to the east; the vehicles needed to make a right turn drive downward from the auxiliary lane to the bridge bottom and then make a right turn to enter the universal lane W in the south direction in the bridge bottom to complete a right turn; the vehicles needed to make a left turn drive upward onto the bridge and in the east direction first, then from the short ramp 3B to go downward and enter the annular ramp 1, make a left turn along the annular ramp 1, go downward along the auxiliary ramp 2A, make a right turn to enter the universal lane W in the north direction at the bridge bottom to complete the left turn of the vehicle in the east direction; the vehicles needed to U-turn have three method. First, the vehicle enters the universal lane W in the west direction through U-turn along the annular ramp on the west side; second, the vehicle first go straight in the east direction along the original lane, then go downward through the short ramp 3B to enter the annular ramp 1, and then go upward through the short ramp 3A to enter the universal lane W in the west direction; third, the vehicle goes upward in the east direction to the bridge and enter the interchange platform 5 on the bridge, then enter the universal lane W in the west direction through the interchange platform 5 to complete the U-turn.

Vehicles in the vicinity of the annular ramp are intertwined. If the ramp connecting to the universal lane W on the bridge has a longer ramp length, there will be less interweaving of the vehicles, and hence the impact on driving speed is reduced.

According to the overpass structure with vertical interchange arrangement for crossroads of the present invention, the top is the interchange platform. After subway passengers arrive to the station, they reach the pedestrian platform 4C in the middle level through the elevator or pedestrian stairway, then they can take the elevator or pedestrian stairway to reach the bus station 501 in the interchange platform 5, or they can take a lift directly to the bus station in the interchange platform to take the bus; if the interchange platform has an apron, passengers can also transfer to the airbus such as helicopters; pedestrians reaching the pedestrian platform in the middle level can go downward to enter the subway station from the subway entrance to take a subway, or go upward to the interchange platform to take a bus, or an Airbus, and vice versa. Obviously, through the overpass with vertical interchange arrangement for crossroads of the present invention, people can easily transfer to the bus or subway, and even transfer to the helicopter, that make the vertical interchange arrangement for crossroads into a passenger and vehicle distribution center. The entrance of subway station is located in the middle level of the overpass structure, which is relatively concentrated, thus capable of avoiding occupying the walkways on the side of the roadway while saving the construction cost of underground passage in the subway station.

When there is waterlogging caused by water under the bridge, the roadway under the bridge cannot be used, the auxiliary lane in the reversing ramp cannot be used, and the function of the universal lane W on the bridge and under the bridge disappears. At this time, the crisscross shape pedestrian walkway 300 can temporarily serve as the roadway of motorized vehicles. The vehicles under the bridge in the north and south direction completely rely on the well-shaped pedestrian walkway 300 to achieve going straight and right turn, the pedestrian platform 4C is utilized for left turn and U-turn, which is exactly identical to the situation of ordinary crossroads.

The vehicles on the bridge can go straight or U-turn according to the original method. The vehicles that turn right on the bridge must go to the rightmost pedestrian walkway before going to the bridge and make use of the crisscross shape pedestrian walkway 300 to make a right turn; the vehicles that turn left on the bridge must also enter the right-most pedestrian walkway before going to the bridge and make use of the well-shaped pedestrian walkway 300 to go forward to the pedestrian platform, then turn left on the pedestrian platform, or it is also possible to make a U-turn here. This shows that water will not cause traffic disruption. The situation at this point is equivalent to an ordinary intersection, traffic flow and the flow of people are affected and traffic police or traffic lights commands are needed.

According to the overpass structure with vertical interchange arrangement for crossroads of the present invention, the interchange platform 5 is also called a universal area. In theory, one or two additional junction can be connected to the universal area, and all the junctions are interconnected through the overpass structure.

The most important feature of the universal area is that: first, anyone who reaches the universal area can move in any direction by means of transportation or walking; second, any vehicle that reaches the universal area can travel to any lanes in any direction on the overpass structure. This is because the universal zone is connected to the two universal lanes of the longitudinal road bridge, while the longitudinal road bridge and the universal lane of the transverse roadway are connected through the reversing ramp. In addition, the universal area is connected to the pedestrian platform and the subway station below by elevator or pedestrian stairway. Crossroads refers to the intersection of the four junctions of the two roadways. So, the universal area on the overpass disclosed in the present invention can also connected to two other new junctions. The two new junctions can be interconnected through the universal area, or through the universal area, the universal lane, the reversing ramp and the other four junctions. It can be seen that the interchange platform is only one of the functions of the universal area. The function of the universal area can be expanded according to the need of development. For example, on the universal area, a roadway for U-turn on the bridge can be arranged, a bus station can be arranged, a helipad can be arranged, a three-dimensional parking structure (or building structure for providing other functions) can be built.

According to the overpass structure with vertical interchange arrangement for crossroads of the present invention, the overpass structure can facilitate motor vehicles to change direction, passenger transfer, vehicles and people distribution while the construction cost of subway can be reduced.

According to the overpass structure with vertical interchange arrangement for crossroads of the present invention, its application is not limited to crossroads in urban cities. The present invention can be applied to other geographical locations, can be used in intersection of two roadways with four junctions, or can be used in intersection with five or six junctions. The structural elements can be added or eliminated, and the actual dimension can be adjusted according to the actual situation such as the flow of people, traffic density, driving speed, type of vehicles, geographical conditions, the number of junctions, and the grading of road level.

Figure 7:
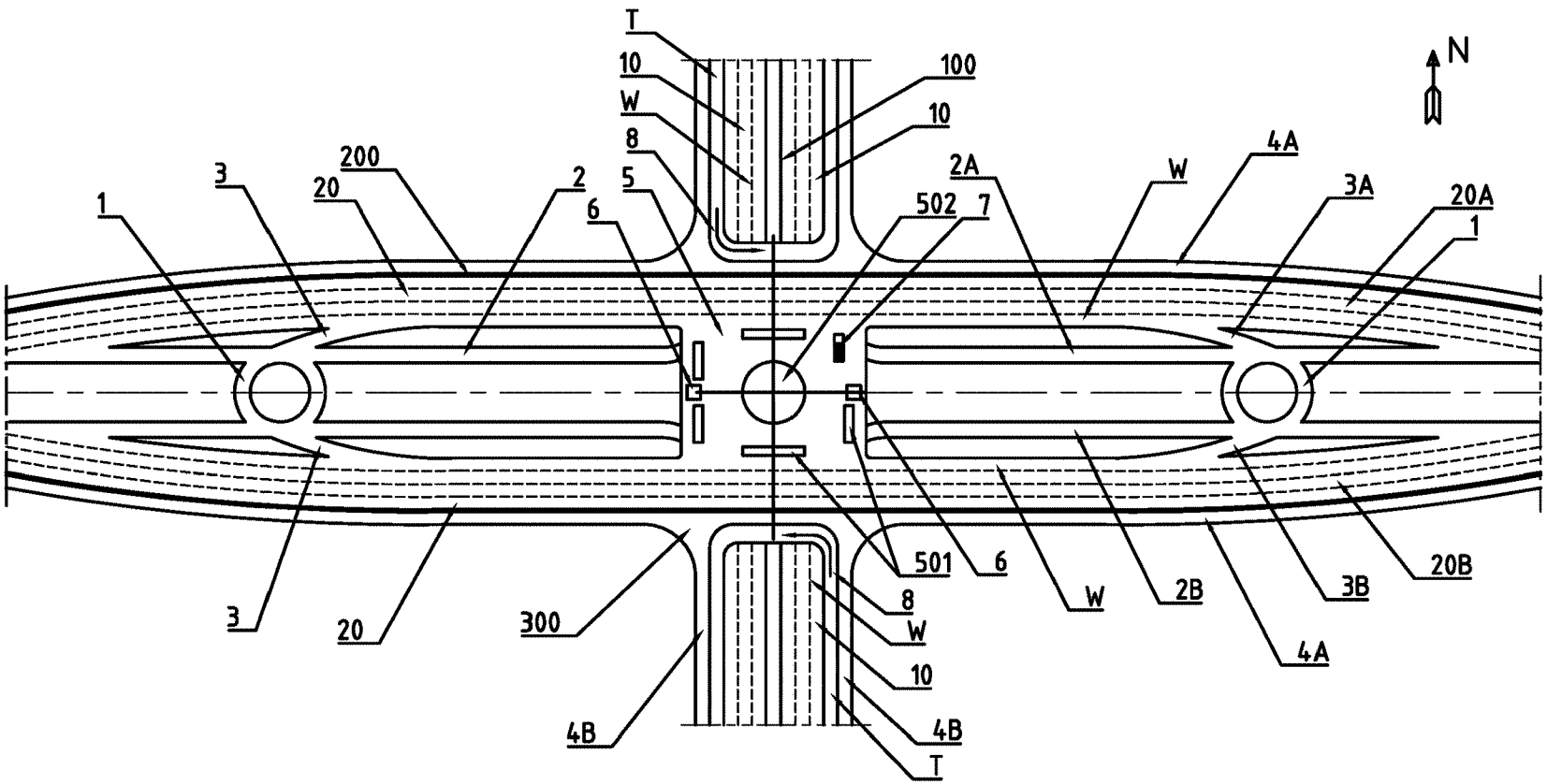
FIG. 7 is a schematic top view of an overpass with vertical interchange arrangement for crossroads according to a third preferred embodiment of the present invention.

Referring to FIG. 7 of the drawings, an overpass with vertical interchange arrangement for crossroads according to a third preferred embodiment of the present invention is illustrated. The third embodiment is identical to the first embodiment except that a pair of U-turn roadway 8 is provided. Referring to FIG. 7 of the drawings, the pair of U-turn roadway 8 is provided by widening the pedestrian walkway at two sides of the two junctions of the crossroads. The pair of U-turn roadway 8 is in the same level as the pedestrian walkway.

Figure 8:
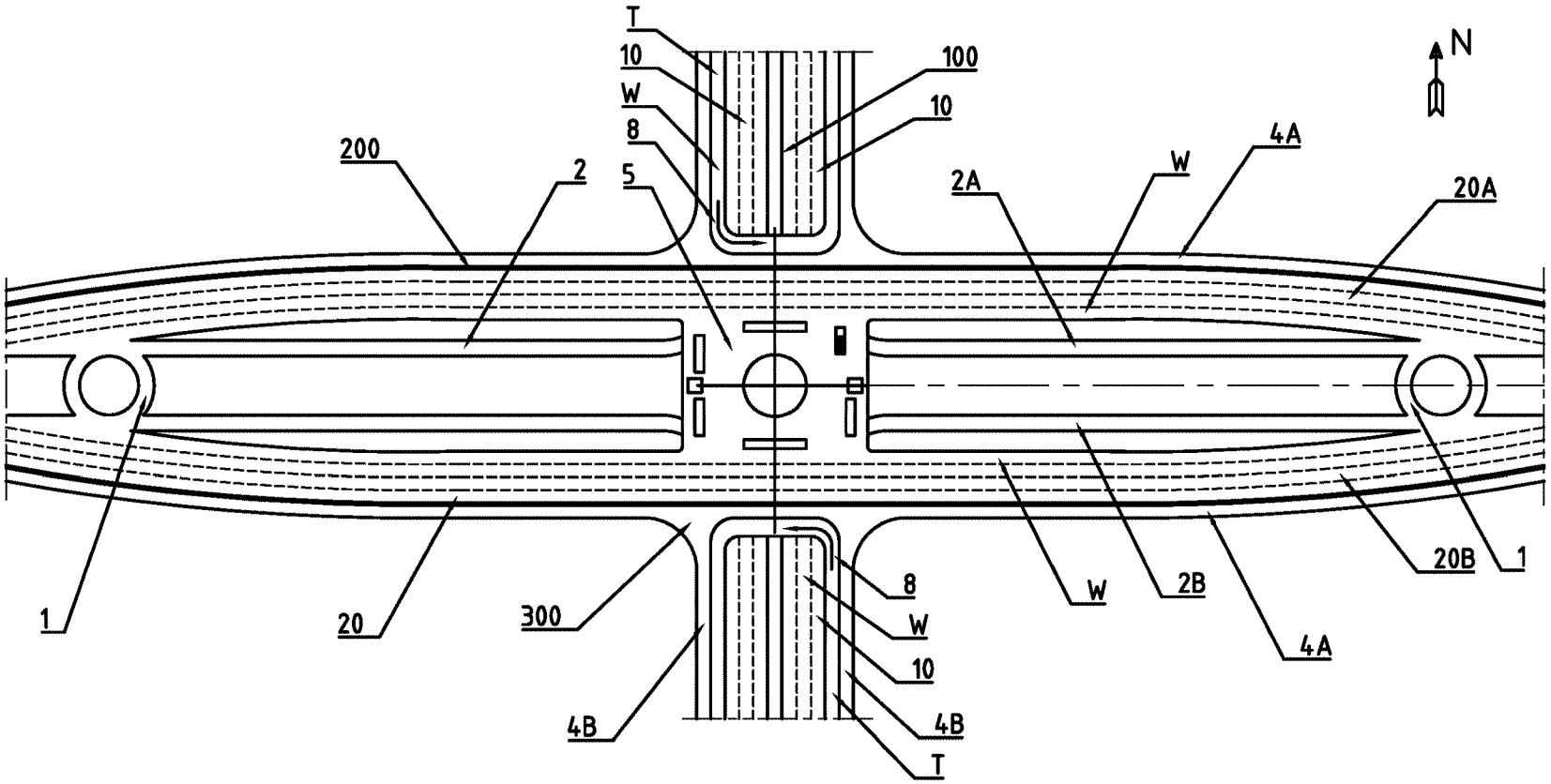
FIG. 8 is a schematic top view of an overpass with vertical interchange arrangement for crossroads according to a fourth preferred embodiment of the present invention.

Referring to FIG. 8 of the drawings, an overpass with vertical interchange arrangement for crossroads according to a fourth preferred embodiment of the present invention is illustrated. The fourth embodiment is identical to the second embodiment except that a pair of U-turn roadway 8' is provided. Referring to FIG. 8 of the drawings, the pair of U-turn roadway 8 is provided by widening the pedestrian walkway at two sides of the two junctions of the crossroads. The pair of U-turn roadway 8 is in the same level as the pedestrian walkway.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An overpass structure with vertical interchange arrangement for crossroads, which comprises a transverse roadway at a bottom level and a longitudinal road bridge at an upper level, wherein each of the transverse roadway and the longitudinal road bridge comprises two vehicle roadways of opposite driving directions respectively, wherein each of the vehicle roadways comprises a plurality of road lanes in the same driving direction, wherein the transverse roadway at the bottom level and the longitudinal road bridge at the upper level are connected through by two reversing ramp units, characterized in that:

the two reversing ramp units are symmetrically arranged on two sides of the transverse roadway, each of the reversing ramp units is arranged between two longitudinal vehicle roadways of opposite directions in the longitudinal road bridge; each of the reversing ramp units comprises one annular ramp and two auxiliary lanes; wherein the annular ramp is arranged between the two auxiliary lanes and is connected to the two auxiliary lanes; wherein the auxiliary lane which is adjacent to an uphill roadway of the longitudinal road bridge is defined as a first auxiliary lane, wherein the auxiliary lane which is adjacent to a downhill roadway of the longitudinal road bridge is defined as a second auxiliary lane; wherein a starting point of the first auxiliary lane is connected to a starting point of the uphill roadway of the longitudinal road bridge, extends forwardly, tangential to the annular ramp, then extends downward to the bottom of the bridge and then turns right to connect with the transverse roadway; the starting point of the second auxiliary lane is connected with the transverse roadway at the bottom of the bridge, turns to the right and then extends upwards, tangential to the annular ramp, and then extends horizontally forward, then an end point is connected to an end point of the downhill roadway of the longitudinal road bridge, the overpass structure further comprises a pedestrian walkway having a crisscross shape formed by two pairs of parallel lines that intersect perpendicularly to each other to form a quadrilateral in the middle, wherein the pedestrian walkway comprises two longitudinal walkways and two transverse walkways, wherein the longitudinal walkway is located at an outer side of the vehicle roadways of the longitudinal road bridge and the transverse walkway is located at an outer side of the vehicle roadways of the transverse roadway, wherein the transverse roadway passes through under the middle of the pedestrian walkway, wherein the pedestrian walkway comprises a pedestrian platform located in the quadrilateral in the middle of the crisscross shape, which is connected to the two longitudinal walkways and the two transverse walkways respectively, wherein the pedestrian walkway is located at a normal ground level, wherein the longitudinal road bridge comprises an interchange platform on top of the pedestrian platform, which is located at the top end of the longitudinal road bridge, and is between two vehicle road lanes of opposite directions in the longitudinal road bridge, while connecting to two vehicle road lanes of the longitudinal road bridge, wherein the interchange platform comprises at least one bus station.

2. The overpass structure with vertical interchange arrangement for crossroads according to claim 1, wherein the interchange platform comprises a helipad.

3. The overpass structure with vertical interchange arrangement for crossroads according to claim 1, further comprising a subway station located right below the crossroads junction under the ground; wherein the subway station is connected to the pedestrian platform and the interchange platform through an elevator and a pedestrian stairway.

4. An overpass structure with vertical interchange arrangement for crossroads, which comprises a transverse roadway at a bottom level and a longitudinal road bridge at an upper level, wherein each of the transverse roadway and the longitudinal road bridge comprises two vehicle roadways of opposite driving directions respectively, wherein each of the vehicle roadways comprises a plurality of road lanes in the same driving direction, wherein the transverse roadway at the bottom level and the longitudinal road bridge at the upper level are connected through by two reversing ramp units, characterized in that:

the two reversing ramp units are symmetrically arranged on two sides of the transverse roadway, each of the reversing ramp units is arranged between two longitudinal vehicle roadways of opposite directions in the longitudinal road bridge; each of the reversing ramp units comprises one annular ramp and two auxiliary lanes; wherein the annular ramp is arranged between the two auxiliary lanes and is connected to the two auxiliary lanes; wherein the auxiliary lane which is adjacent to an uphill roadway of the longitudinal road bridge is defined as a first auxiliary lane, wherein the auxiliary lane which is adjacent to a downhill roadway of the longitudinal road bridge is defined as a second auxiliary lane; wherein a starting point of the first auxiliary lane is connected to a starting point of the uphill roadway of the longitudinal road bridge, extends forwardly, tangential to the annular ramp, then extends downward to the bottom of the bridge and then turns right to connect with the transverse roadway; the starting point of the second auxiliary lane is connected with the transverse roadway at the bottom of the bridge, turns to the right and then extends upwards, tangential to the annular ramp, and then extends horizontally forward, then an end point is connected to an end point of the downhill roadway of the longitudinal road bridge, wherein a universal lane on the bridge and under the bridge are connected by the reversing ramp unit, wherein the universal lane on the bridge in the longitudinal road bridge is the leftmost lane with respect to a forward moving direction of vehicle, wherein the universal lane under the bridge in the transverse roadway is the rightmost lane with respect to a forward moving direction of vehicle.

5. The overpass structure with vertical interchange arrangement for crossroads according to claim 4, wherein the longitudinal road bridge comprises an interchange platform on top of the pedestrian platform at the top end of the longitudinal road bridge, wherein the interchange platform is connecting the two universal lane of the longitudinal road bridge, wherein the universal lanes of the longitudinal road bridge and the transverse roadway are connected through the reversing ramp unit, wherein the interchange platform is connected to the pedestrian platform and the subway station below through an elevator or a pedestrian stairway.

6. The overpass structure with vertical interchange arrangement for crossroads according to claim 4, wherein the interchange platform is a universal area arranged for anyone who reaches the universal area to go to any places by means of transportation or walking, and for any vehicle that reaches the universal area to go to any lanes in any direction, wherein the crossroads are the intersection of four junctions between two roadways, wherein the interchange platform is connected to the four junctions of the crossroads and is capable of connecting to two additional junctions of which a corresponding walkway and roadway of the two additional junctions are connected to the universal area, wherein the interchange platform is capable of development to provide other functions based on an actual need requirements.

7. The overpass structure with vertical interchange arrangement for crossroads according to claim 4, wherein the interchange platform is a universal area arranged for anyone who reaches the universal area to go to any places by means of transportation or walking, and for any vehicle that reaches the universal area to go to any lanes in any direction, wherein the crossroads are the intersection of four junctions between two roadways, wherein the interchange platform is connected to the four junctions of the crossroads and is capable of connecting to two additional junctions of which a corresponding walkway and roadway of the two additional junctions are connected to the original four junctions through the universal area, the universal lane and the reversing ramp unit, wherein the interchange platform is capable of development to provide other functions based on an actual need requirements.

8. The overpass structure with vertical interchange arrangement for crossroads according to claim 6, wherein the overpass structure is applicable to intersection with five or six junctions.

* * * * *